US010932059B2

(12) United States Patent
Liu et al.

(10) Patent No.: US 10,932,059 B2
(45) Date of Patent: Feb. 23, 2021

(54) SPEAKER

(71) Applicant: AAC Technologies Pte. Ltd., Singapore (SG)

(72) Inventors: Xiaodong Liu, Shenzhen (CN); Long Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/706,743

(22) Filed: Dec. 7, 2019

(65) Prior Publication Data

US 2020/0213760 A1 Jul. 2, 2020

(30) Foreign Application Priority Data

Dec. 29, 2018 (CN) ..... 201811646643.8

(51) Int. Cl.

| | |
|---|---|
| ***H04R 9/06*** | (2006.01) |
| ***H04R 7/12*** | (2006.01) |
| ***H04R 7/18*** | (2006.01) |
| ***H04R 9/02*** | (2006.01) |

(52) U.S. Cl.

CPC ..... *H04R 9/06* (2013.01); *H04R 7/12* (2013.01); *H04R 7/18* (2013.01); *H04R 9/025* (2013.01); *H04R 2400/11* (2013.01)

(58) Field of Classification Search

CPC combination set(s) only.
See application file for complete search history.

(56) References Cited

U.S. PATENT DOCUMENTS

| | | | | |
|---|---|---|---|---|
| 9,813,821 | B1 * | 11/2017 | Song | H04R 9/025 |
| 10,674,279 | B1 * | 6/2020 | Liu | H04R 9/025 |
| 10,728,672 | B2 * | 7/2020 | Kim | H04R 9/045 |
| 2018/0027335 | A1 * | 1/2018 | Li | H04R 9/025 381/398 |

FOREIGN PATENT DOCUMENTS

| | | | |
|---|---|---|---|
| CN | 205142501 | B1 | 4/2016 |
| CN | 108322870 | A1 | 7/2018 |

OTHER PUBLICATIONS

PCT search report dated Jan. 6, 2020 by SIPO in related PCT Patent Application No. PCT/CN2019/110614 (4 Pages).

* cited by examiner

*Primary Examiner* — Fan S Tsang
*Assistant Examiner* — Angelica M McKinney
(74) *Attorney, Agent, or Firm* — W&G Law Group LLP

(57) ABSTRACT

The present invention discloses a speaker having a frame, a vibrating system and a magnetic circuit system. The vibrating system has a vibrating diaphragm, a voice coil and an elastic supporting assembly. The magnetic circuit system has a main magnet, a secondary magnet and a magnetic plate having a main body and a supporting portion opposite to the elastic supporting assembly. The elastic supporting assembly has an avoiding hole penetrating there through and facing to the supporting portion. The yoke has a yoke body fixed on the frame and an extending portion extending from two opposite sides of the yoke body towards the supporting portion. The extending portion passes through the avoiding hole thereof and attach on the supporting portion. The speaker of the present invention has advantages of good reliability and excellent acoustic performance.

7 Claims, 5 Drawing Sheets

A-A

SPEAKER

FIELD OF THE PRESENT INVENTION

The present invention relates electro acoustic field, and more particularly to a speaker applied to a portable electronic product.

DESCRIPTION OF RELATED ART

With the advent of the mobile Internet era, the number of smart mobile devices is continuously increasing. Among numerous mobile devices, mobile phones are undoubtedly the most common and portable mobile terminal devices. A speaker for playing sound is widely applied to smart mobile devices, such as mobile phone. A vibrating system and a magnetic circuit system applied in the speaker are directly related to the sound quality of the speaker.

In the related art, a vibrating system of a speaker includes a diaphragm fixed on a frame and used for vibrating to generate sound, a voice coil attached to the vibrating diaphragm, an elastic supporting assembly supported the voice coil at an end away from the vibrating diaphragm and used for enhancing the horizontal stability of the voice coil. The magnetic circuit system comprises a yoke fixed on the frame, a main magnet fixed on the yoke, a secondary magnet located on opposite sides of the main magnet and spaced from the main magnet to form a magnetic gap, and a magnetic plate stacked on the secondary magnet. The elastic supporting assembly is located on the other two opposite sides of the main magnet.

However, in the present speaker, the gaps between the part of the magnetic plate facing to the elastic supporting assembly and the voice coil is too large, so that the space is not effectively utilized, thereby limiting the acoustic performance of the speaker.

Therefore, it is necessary to provide a new speaker which can overcome the above-mentioned problems.

BRIEF DESCRIPTION OF THE DRAWINGS

The embodiment of the present invention will be more clearly understood from the following drawings. It is obvious that the following described drawings are only some embodiments of the invention. For the person skilled in the art, he can achieve the other drawings from these drawings without any creative work.

DETAILED DESCRIPTION OF THE EXEMPLARY EMBODIMENT

The technical solution in the embodiments of the invention will be clearly and completely described by combining with the drawings in the embodiments of the invention. Apparently, the described embodiments are only parts of the embodiments of the invention, but not all of the embodiments. Based on these embodiments, all the other embodiments that the person skilled in the art can achieve without making creative work, are belong to the scope of protection of the invention.

Figure 1:
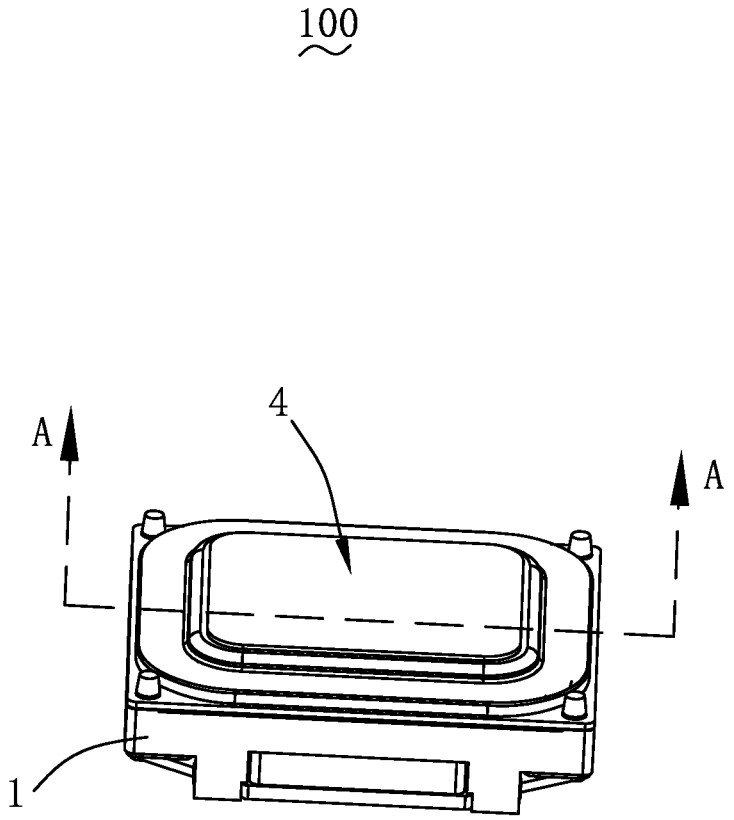
FIG. 1 is an isometric view of a speaker according to the present invention.
Figure 2:
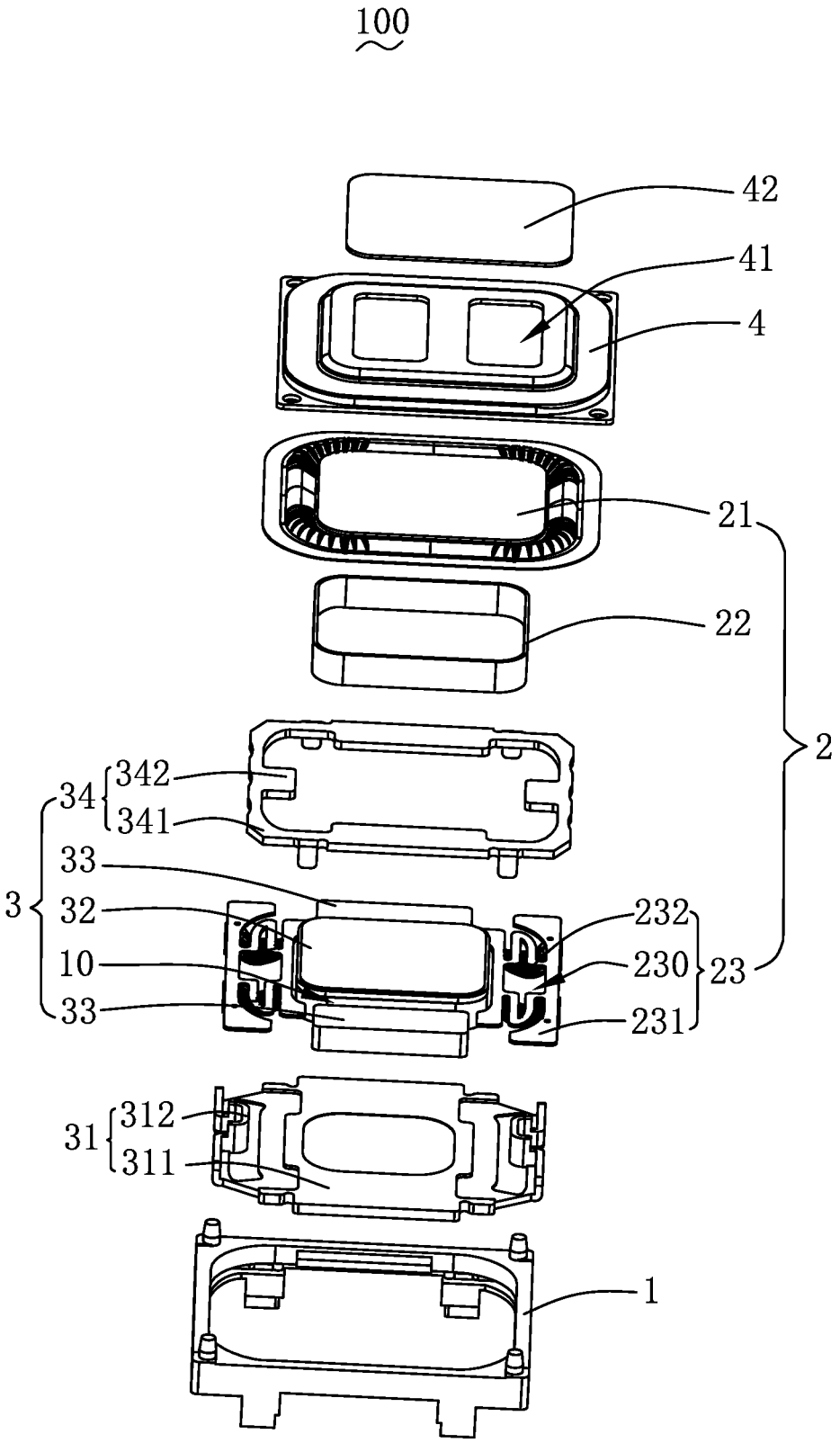
FIG. 2 is a part isometric and exploded view of the speaker in FIG. 1 according to the present invention.
Figure 3:
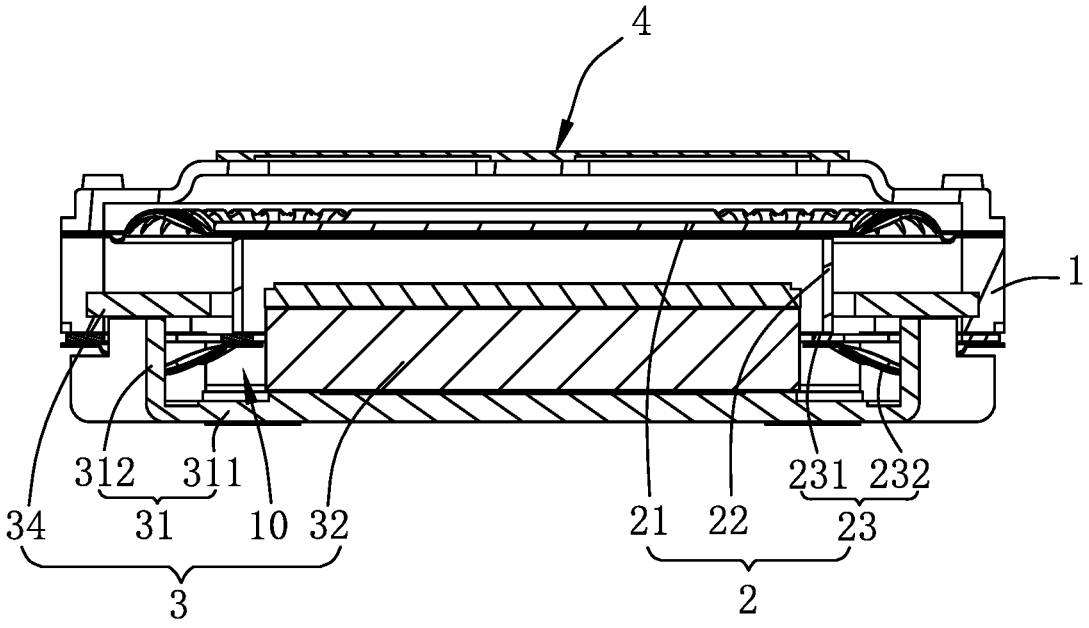
FIG. 3 is a cross-sectional view of the speaker taken along a line A-A in FIG. 1.
Figure 4:
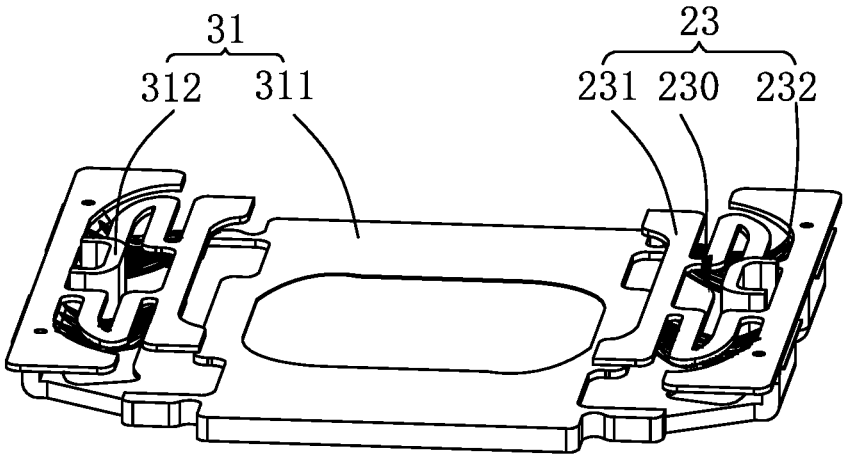
FIG. 4 is an assembling view of a yoke and an elastic supporting assembly of the speaker according to the present invention.
Figure 5:
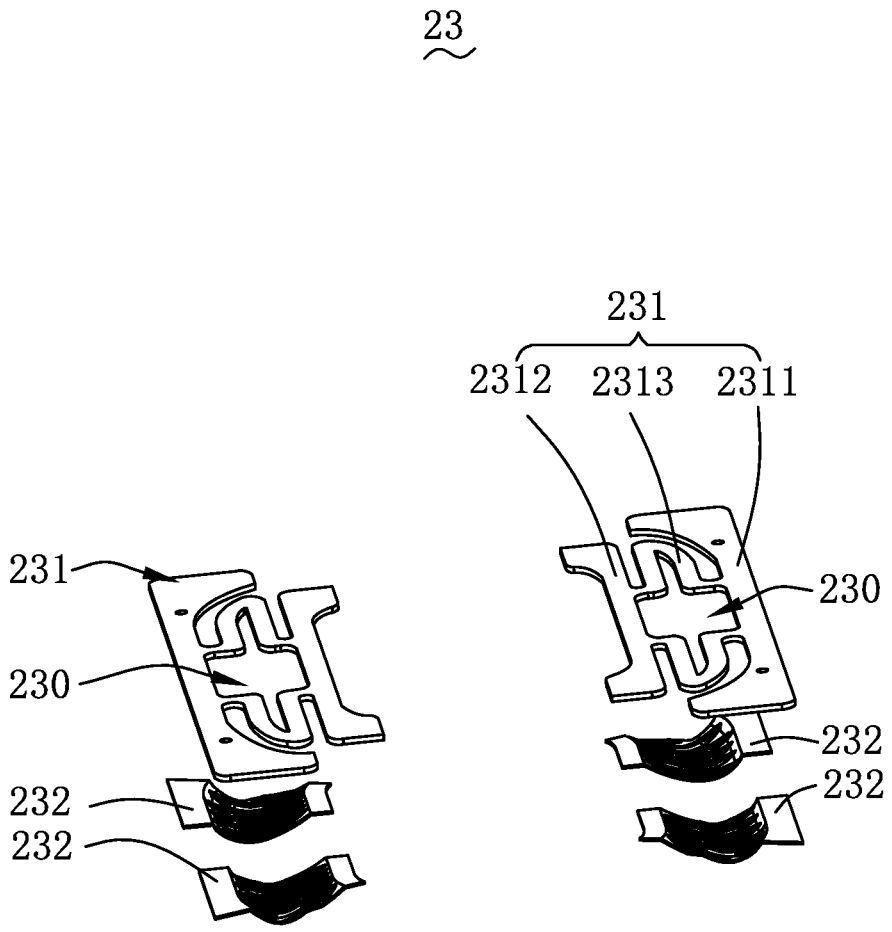
FIG. 5 is an isometric and exploded view of the elastic supporting assembly of the speaker according to the present invention.

Referring to FIGS. 1-5, the present invention discloses a speaker 100 which includes a frame 1, a vibrating system 2 and a magnetic circuit system 3 both accommodated in the frame 1, and a front cover 4. The magnetic circuit system 3 is provided with a magnetic gap 10, and is used for driving the vibrating system 2 to generate sound.

The vibrating system 2 includes a vibrating diaphragm 21 fixed on the frame 1, a voice coil 22 fixed on the vibrating diaphragm 21 and inserted into the magnetic gap 10 for driving the vibrating diaphragm 21 to generate sound, and an elastic supporting assembly 23 fixed on the frame 1 and connected to the voice coil 22 at an end away from the vibrating diaphragm 21.

In this embodiment, the elastic supporting assembly 23 includes an elastic member 231, an auxiliary vibrating diaphragm 232 connected to the elastic member 231 at a side away from the vibrating diaphragm 21 and an avoiding hole 230 penetrating there through.

Specifically, the elastic member 231 includes a first arm 2311 fixed on the frame 1, a second arm 2312 fixed on the voice coil 22 and two elastic arms 2313 respectively connected to the first arm 2311 and the second arm 2312. The two elastic arms 2313 are spaced, and surround and form the avoiding hole 230 together with the first arm 2311 and the second arm 2312. One end of the elastic member 231 is fixed on the frame 1, the other end is connected to the voice coil 22 at an end away from the vibrating diaphragm 21. The auxiliary vibrating diaphragm 232 is connected to the elastic member 231, e.g., the auxiliary vibrating diaphragm 232 is fixedly bonded with the elastic member 231 at a side away from the vibrating diaphragm 21. The voice coil 22 at the end away from the diaphragm 21 is connected with the frame 1 through the elastic supporting assembly 23. The above structure is used on the one hand for enhancing the vibrating effect of the diaphragm 21 to improve the acoustic performance of the speaker 100, and on the other hand for balancing the sway of the vibrating system 2 to improve the stability of the speaker 100. It should be noted that the elastic supporting assembly 23 can include only one of the elastic member 231 or the auxiliary vibrating diaphragms 232, which is also feasible.

Preferably, the elastic supporting member 231 is a flexible circuit board, and the voice coil 22 is electrically connected to the elastic supporting assembly 23. The structure is used on the one hand for improving the vibration intensity and restricting the sway of the vibrating system 2, and on the other hand for leading out the voice coil 22 to the external power, thus to avoid the risk that the voice coil leading wire is easily broken when it is led out to the external power by the voice coil leading wire.

In the present invention, the auxiliary vibrating diaphragm 232 is two-piece type and arranged at two opposite sides of the avoiding hole 230. The avoiding hole 230 passes through the elastic member 231 and the auxiliary vibrating diaphragm 232 respectively.

The magnetic circuit system 3 comprises a yoke 31 fixed on the frame 1, a main magnet 32 fixed on the yoke 31, a secondary magnet 33 located on opposite sides of the main magnet 32 and spaced away from the main magnet 32 to form the magnetic gap 10, and a magnetic plate 34 attached on the secondary magnet 33 and spaced away from the elastic supporting assembly 23. An orthographic projection of the elastic supporting assembly 23 on the yoke 31 along a vibrating direction of the vibrating diaphragm 21, and an orthographic projection of the secondary magnet 33 on the yoke 31 along the vibrating direction of the vibrating diaphragm 21 at least do not overlap partially, and preferably do not overlap at all.

In this embodiment, the magnetic plate 34 includes a main body 341 in an annular shape stacked on the secondary magnet 33 and a supporting portion 342 extending from two opposite sides of the main body 341 towards the main magnet 32 and spaced from the voice coil 22. The supporting portion 342 is facing to the elastic supporting assembly 23. The supporting portion 342 is facing to the avoiding hole 230. The yoke 31 includes a yoke body 311 fixed on the frame 1 and an extending portion 312 extending from two opposite sides of the yoke body 311 towards the supporting portion 342. The extending portion 312 passes through the corresponding avoiding hole 230 and attaches on the corresponding supporting portion 342. The extending portion 312 is connected with the supporting portion 342 so as to form a closed loop. The extending portion 312 is set closer to the main magnet 32 due to the arrangement of the supporting portion 342, thereby the density of the magnetic field lines in the magnetic gap is increased effectively, thus to improve the driving performance.

In this embodiment, the magnetic plate 34 is rectangular. Specifically, the main body 341 is rectangular, two opposite sides along a longitudinal direction of the main body 341 is stacked on the secondary magnet 33. The extending portion 312 is formed by extending from two opposite sides along a lateral direction of the main body 341 and suspended between the vibrating diaphragm 21 and the elastic supporting assembly 23. The extending portion 312 is located at two opposite sides of the main body 341 so that the magnetic field intensity of both sides is increased, and forms the magnetic gap 10 hereby with two opposite sides along the lateral direction of the main magnet 32. A section of the extending portion 312 along a direction perpendicular to the vibrating direction of the vibrating diaphragm 21 is in an arc shape. The structure is benefit for the extending portion 312 to match with the shape of the avoiding hole 230 so that the elastic supporting assembly 23 has a better vibrating balance.

In this embodiment, the elastic supporting assembly 23 is located on the other two opposite sides of the main magnet 32. The avoiding hole 230 of the elastic supporting assembly 23 is facing to the supporting portion 342. The elastic supporting assembly 23 is centrally symmetrical with respect to the main magnet 32 so that the vibrating system 2 has a better vibrating balance.

That is, in this embodiment, the elastic supporting assembly 23 is located on the other two opposite sides of the main magnet 32.

In this embodiment, the main magnet 32 is rectangular. The secondary magnet 33 is located at two opposite sides along the longitudinal direction of the main magnet 32, the elastic supporting assembly 23 is located at two opposite sides along a lateral direction of the main magnet 32. That is, the avoiding hole 230 is located at two opposite sides along the lateral direction of the main magnet 32, and the supporting portion 342 is also located at two opposite sides along the lateral direction of the main magnet 32. Namely, the extending portion is located at two opposite sides along the lateral direction of the main magnet 32. This structure can greatly keep the structure volume of the magnetic circuit system 3 maximized, thus to enhance the strength of the magnetic field.

In the related art, the part of the magnetic plate 34 facing to the elastic supporting assembly 23 is avoided for the elastic supporting assembly 23 and no magnet structure is arranged thereof, so that there remains a large space being not effectively utilized from this part to the voice coil 22 and to the vibrating diaphragm 21, which limits the driving force of the magnetic circuit system 3, and thereby limits the acoustic performance of the speaker 100. Therefore, in the embodiment of the present invention, the extending portion 312 is extended from the yoke 31 at the above part of the magnetic plate 34, the extending portion 312 is equivalent to a magnet structure arranged at the above part, so the extra space is utilized, and the driving performance of the magnetic circuit system 3 is greatly improved, so that the speaker 100 has a better acoustics performance.

Naturally, the structure is not limited to the above, a same effect can also be achieved by directly arranging a magnet on the extending portion 312 and fixing on the yoke 31.

The front cover 4 is positioned on a side of the frame 1, which side is close to the diaphragm 21, and forms a sounding cavity surrounded together with the vibrating diaphragm 21. The front cover 4 is provided with a sound port 41 and a damping layer 42 covered on the sound port 41, which are used for achieving the adjustment of high frequency acoustic performance of the sound.

Compared with the related prior art, the speaker of the present invention includes a vibrating diaphragm, a voice coil fixed on the vibrating diaphragm for driving the vibrating diaphragm to vibrate, and an elastic supporting assembly connected to the voice coil at the end away from the diaphragm. The supporting portion is arranged at the part of the magnetic plate facing to the elastic supporting assembly, and the extending portion is arranged on the above part via the yoke and attaches on the supporting portion. Because of the above structure, the space between the part of the magnetic plate faces to the elastic supporting assembly and the vibrating diaphragm is fully utilized by arranging the the extending portion hereof. Therefore the driving force of the magnetic circuit system is greatly improved, the acoustic performance of the speaker is effectively improved, the vibration symmetry of the speaker is improved, and the reliability becomes better.

The above is only the embodiment of the present invention, and it should be noted that those skilled in the art can still make improvements without departing from the inventive concepts, and these improvements are all belong to the protection scope of the present invention.

What is claimed is:

1. A speaker, comprising a frame, a vibrating system and a magnet circuit system with a magnetic gap both accommodated in the frame respectively, wherein, the vibrating system comprises a vibrating diaphragm fixed on the frame, a voice coil fixed on the vibrating diaphragm and inserted into the magnetic gap for driving the vibrating diaphragm, and an elastic supporting assembly fixed on the frame and connected to the voice coil at an end away from the vibrating diaphragm;

the magnetic circuit system comprises a yoke fixed on the frame, a main magnet fixed on the yoke, a secondary magnet located on two opposite sides of the main magnet and spaced away from the main magnet for forming the magnetic gap, and a magnetic plate stacked on the secondary magnet and spaced away from the elastic supporting assembly;

an orthographic projection of the elastic supporting assembly on the yoke along a vibrating direction of the vibrating diaphragm, and an orthographic projection of the secondary magnet on the yoke along the vibrating direction of the vibrating diaphragm at least do not overlap partially;

the magnetic plate includes a main body in an annular shape stacked on the secondary magnet and a supporting portion extending from two opposite sides of the main body towards the main magnet and spaced away from the voice coil; the supporting portion is facing to the elastic supporting assembly;

the elastic supporting assembly has an avoiding hole penetrating there through and facing to the supporting portion;

the yoke includes a yoke body fixed on the frame and an extending portion extending from two opposite sides of the yoke body toward the supporting portion; the extending portion passes through the avoiding hole thereof and attach on the supporting portion.

2. The speaker according to claim 1, wherein the main magnet is rectangular, and the secondary magnet is positioned at two opposite sides along a longitudinal direction of the main magnet, and the elastic supporting assembly is located at two opposite sides along a lateral direction of the main magnet.

3. The speaker according to claim 2, where in the main body is rectangular, two opposite sides along a longitudinal direction of the main body is stacked on the secondary magnet; the extending portion is formed by extending from two opposite sides along a lateral direction of the main body, and suspended between the vibrating diaphragm and the elastic supporting assembly.

4. The speaker according to claim 1, wherein the elastic supporting assembly includes an elastic member, one end of the elastic member is fixed on the frame, and the other end of the elastic member is fixed on the voice coil at an end away from the vibrating diaphragm; the elastic member includes a first arm fixed on the frame, a second arm fixed on the voice coil and two elastic arms connected the first arm and the second arm respectively; the two elastic arms are spaced, and surround and form the avoiding hole together with the first arm and the second arm.

5. The speaker according to claim 4, wherein the elastic supporting assembly further comprises an auxiliary vibrating diaphragm connected to the elastic member at a side away from the vibrating diaphragm; the auxiliary vibrating diaphragm is two-piece type and arranged at two opposite sides of the avoiding hole.

6. The speaker according to claim 4, where in the elastic member is a flexible circuit board, and the voice coil is electrically connected to the elastic member.

7. The speaker according to claim 1, where in a section of the extending portion along a direction perpendicular to the vibrating direction of the vibrating diaphragm is an arc shape.

* * * * *